US009003615B1

(12) United States Patent
Cates, Jr. et al.

(10) Patent No.: US 9,003,615 B1
(45) Date of Patent: Apr. 14, 2015

(54) SILENT HOOK AND LOOP FASTENER SYSTEM

(76) Inventors: Marion Harlan Cates, Jr., Birmingham, AL (US); Alex F. Farris, III, Birmingham, AL (US)

( * ) Notice: Subject to any disclaimer, the term of this patent is extended or adjusted under 35 U.S.C. 154(b) by 136 days.

(21) Appl. No.: 13/615,400

(22) Filed: Sep. 13, 2012

(51) Int. Cl.
*A44B 18/00* (2006.01)

(52) U.S. Cl.
CPC ..... *A44B 18/0003* (2013.01); *A44B 18/0069* (2013.01)

(58) Field of Classification Search
CPC ..... A44B 18/0046; A44B 18/0096; A44B 18/003; F16B 5/07
USPC ..... 24/442–452, 306; 428/99, 100
See application file for complete search history.

(56) References Cited

U.S. PATENT DOCUMENTS

| | | | | |
|---|---|---|---|---|
| 3,905,071 | A * | 9/1975 | Brumlik | 24/706.4 |
| 4,984,339 | A | 1/1991 | Provost et al. | |
| 5,611,122 | A | 3/1997 | Torigoe et al. | |
| 5,731,056 | A * | 3/1998 | Butler, III | 428/100 |
| 6,112,377 | A * | 9/2000 | Wilson | 24/452 |
| 6,598,274 | B1 | 7/2003 | Marmaropoulos | |
| 6,766,566 | B2 | 7/2004 | Chang et al. | |
| 6,849,142 | B1 * | 2/2005 | Goulait | 156/62.4 |
| 6,872,439 | B2 * | 3/2005 | Fearing et al. | 428/99 |
| 7,032,278 | B2 * | 4/2006 | Kurtz, Jr. | 24/442 |
| 7,032,282 | B2 * | 4/2006 | Powell et al. | 29/426.4 |
| 7,308,738 | B2 | 12/2007 | Barvosa-Carter et al. | |
| 7,430,788 | B2 | 10/2008 | Ottaviani et al. | |
| 8,578,570 | B1 * | 11/2013 | Dwight | 24/306 |
| 8,745,827 | B2 * | 6/2014 | Rocha | 24/442 |
| 2006/0090307 | A1 * | 5/2006 | McDaniel et al. | 24/442 |
| 2012/0011685 | A1 * | 1/2012 | Rocha | 24/449 |

* cited by examiner

*Primary Examiner* — Robert J Sandy
*Assistant Examiner* — Matthew Sullivan
(74) *Attorney, Agent, or Firm* — Gerald M. Walsh; Leo Law Firm, LLC

(57) ABSTRACT

A silent fastener system having a hook portion and a loop portion wherein the hook portion has a base with hooks attached thereto. The hooks are biased in a curved configuration and are inserted through a hook guide which guides the hooks into the loop portion by moving the base along the hook guide in a first direction so that tips of the hooks advance into the loop portion. The hooks become curved in the loop portion thereby locking the hooks in the loop portion. The hooks are unlocked by moving the base in a second opposite direction causing the loops to retract into the hook guide without producing sound so that the hook and loop portions separate easily with production of audible sound. Alternate embodiments use linear hooks in place of curved hooks.

5 Claims, 5 Drawing Sheets

SILENT HOOK AND LOOP FASTENER SYSTEM

FIELD OF THE INVENTION

The present invention relates to the field of hook and loop fasteners and, more particularly, to a silent hook and loop fastener system that locks and unlocks a hook element to a loop element and wherein the hook element and the loop element can be separated from each other with little resistance and with little production of any audible sound, compared to standard hook and loop systems.

BACKGROUND OF THE INVENTION

Hook and loop fasteners are known in the art and they have been used in many diverse applications. The secure engagement of one half to the other and the substantial force required to separate the two halves has made these fasteners popular and useful. However, the force that must be applied to achieve separation of the two halves can make the separation process difficult in some cases and can produce sound or noise which may be undesirable. The inherently incremental nature of the known separation process requiring the two halves to be progressively "peeled" apart is generally responsible for the production of significant sound or noise. This sound or noise can make the use of hook and loop fasteners unsatisfactory in situations where silence is necessary such as in military combat situations or hunting activities. Hook and loop fasteners designed for "heavy duty" applications with substantial holding force can require separation forces which may exceed the physical ability of certain users thereby further limiting the application of these types fastening devices. Hook and loop fasteners are known which produce substantial holding force using electrical, magnetic, or thermal systems to lock and unlock hooks from loops. These systems are complex and relatively expensive and may not be practical in situations such as military combat or hunting activities.

What is needed is a hook and loop system with substantial holding force that can be operated manually which is easy to lock and unlock without generating any significant audible sound or noise.

SUMMARY OF THE INVENTION

This invention is a relatively silent fastener system having a hook portion and a loop portion wherein the hook portion has a base with hooks attached thereto and the hooks are biased in a curved configuration. The hooks are inserted through a hook guide and guided into the loop portion, when the loop portion interfaces with the hook guide. This is accomplished by moving the base away from a first side of the hook guide towards a second opposite side of the hook guide so that tips of the hooks advance into the loop portion. The hooks become more curved in this configuration thereby locking the hooks into the loop portion. The hooks can be further guided into the loop portion so that the hooks become more curved and the tips of the hooks advance further through the loop portion back into the hook guide. The hooks are unlocked and removed from the loop portion by moving the base away from the second opposite side of the hook guide towards the first side of the hook guide so that the hooks are retracted out of the loop portion and into the hook guide with little production of any audible sound or noise. The loop portion and the hook guide can, thus, be separated from each other with little resistance and with little production of any audible sound when the hooks are retracted out of the loop portion and back into the hook guide.

In alternate embodiments of this invention the hooks can have a linear configuration and are attached to a base at an angle of 20 degrees to 75 degrees relative to the base, and are angled from a first side of the base towards a second opposite side of the base The hooks are advanced into the loop portion at an angle, thereby locking the hooks into the loop portion. The hooks are unlocked from the loop portion by pulling them in reverse out of the loop portion at the same angle of insertion with little production of audible sound. In another embodiment a hook guide can also be used with this system. In yet another embodiment a plurality of linear hooks are positioned at the ends of a stretchable hook base at an angle wherein the hooks are angled towards the center of the stretchable hook base. The stretchable hook base is stretched so that the hooks can enter the loop portion at an angle as the stretchable hook base is allowed to return to its unstretched configuration, thereby locking the hooks into the loop portion. The hooks are unlocked from the loop portion by stretching the stretchable base and pulling the hooks in reverse out of the loop portion at the same angle of insertion with little production of audible sound. The flexible pull features of this embodiment are especially useful in emergency closing of wounds for medical applications.

In yet another embodiment the hook portion has a plurality of first hook bases with linear first hooks attached thereto, with the first hooks attached to each of the first hook bases at a first angle, and being angled in a first direction in line with the first hook base. The plurality of the first hook bases are attached to a first base holder wherein there is a space between each of the first hook bases. The hook portion also has a plurality of second hook bases with linear second hooks attached thereto, with the second hooks attached to each of the second hook bases at a second angle, and being angled in an opposite second direction in line with the second hook base. The plurality of the second hook bases are attached to a second base holder wherein there is a space between each of the second hook bases. The first hook bases are slidably positioned between the second hook bases so that the first hooks overlap the second hooks when the first and the second base holders are moved towards each other, and do not overlap each other when the first and the second base holders are moved away from each other. The hook portion is fastened and locked to the loop portion by moving the first and the second base holders from a non-overlapped configuration to an overlapped configuration of the first and second hooks. The hook portion is unlocked and unfastened from the loop portion by moving the first and the second base holders from an overlapped configuration to a non-overlapped configuration of the first and second hooks.

An advantage of the invention is a hook and loop system that generates little or no audible sound when the hook and loop portions are locked together or unlocked and separated.

Another advantage is effortless detachment of the hook portion from the loop portion.

Another advantage is that curved hooks or linear hooks can be used in the hook and loop system.

Another advantage is a hook and loop arrangement that provides up to 5 times more resistance to detachment when in a locked configuration compared to standard hook and loop arrangements.

Another advantage is a simple manual system for locking and unlocking the hook portion to the loop portion.

DETAILED DESCRIPTION OF THE INVENTION

Figure 1A:
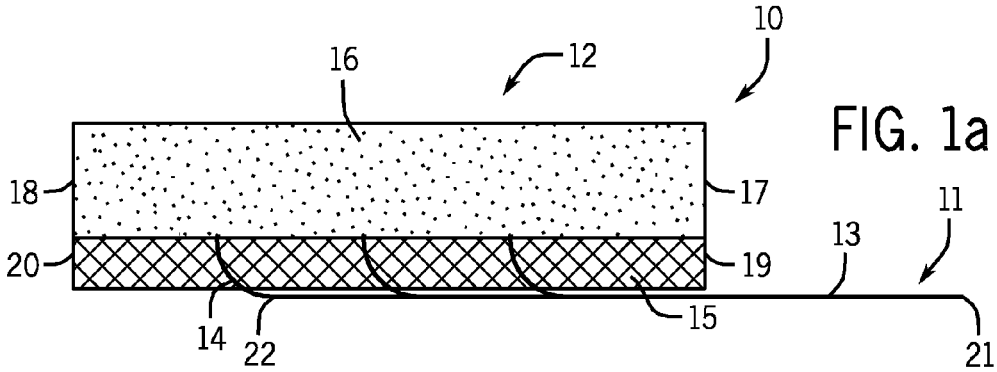
FIGS. 1*a*-1*d* show an embodiment of the present invention using flexible curved hooks on a sliding hook base.

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

FIGS. 1*a*-1*d* show illustrations of a first embodiment of the silent fastener system 10 of the present invention. The fastener 10 has a hook portion 11 and a loop portion 12. The expression "loop portion" also includes the concept of a pile. Hook and loop and hook and pile fasteners are known in the art, particularly, for example, as Velcro™. The hook portion 11 has a moveable hook base 13 with hooks 14 attached thereto and a hook guide 15 in which the hooks are movably inserted. Hooks 14 are flexible and are biased into a curvilinear shape so that they form up to a complete circular shape spontaneously with a spring-like function. They can also be bent into an almost complete linear shape. Loop portion 12 is made of material having loops or a pile-type formation 16. The loop portion 12 has a first side 17 and a second opposite side 18. The hook guide 15 has a first side 19 and a second opposite side 20. The hook base 13 has a first side 21 and a second opposite side 22.

Figure 1B:
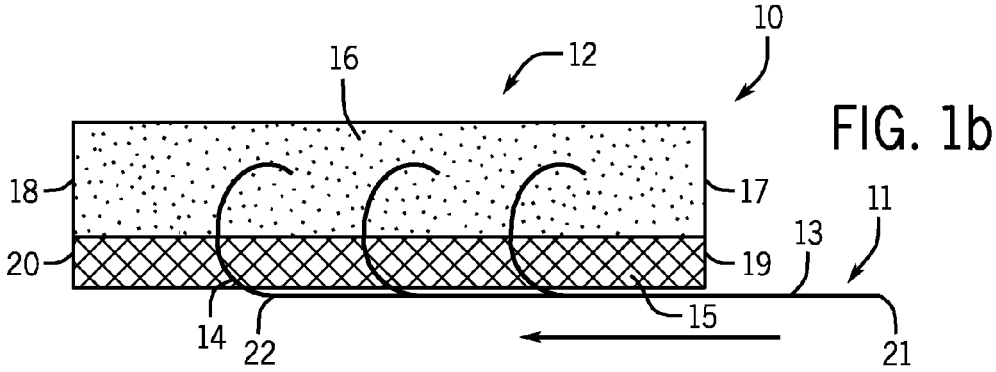
Figure 1C:
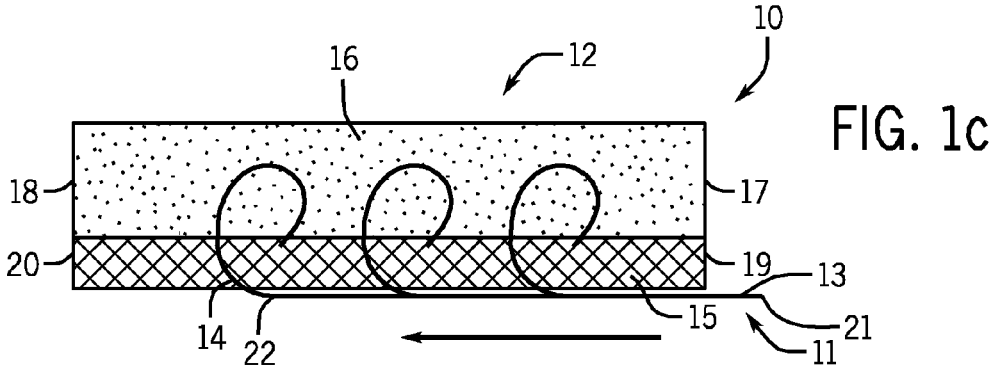
Figure 1D:
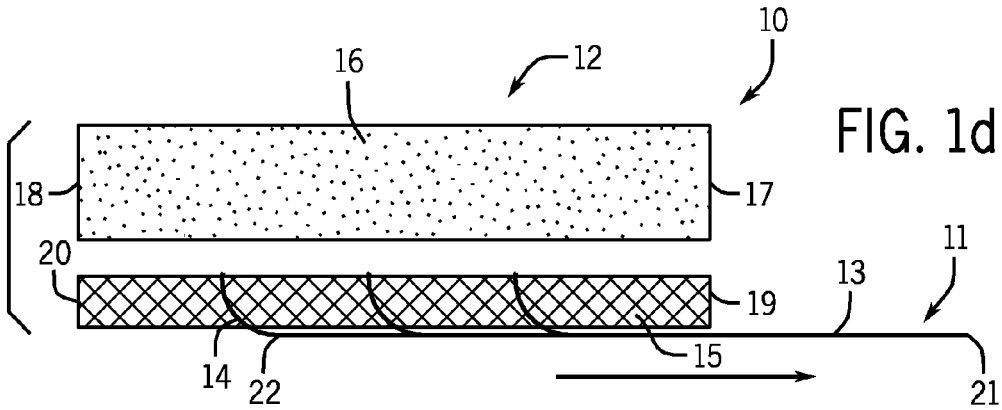

FIG. 1*a* shows the loop portion 12 on top of the hook portion 11. The hooks 14 are inserted into the hook guide 15 from the bottom side of the hook guide 15 but do not protrude out of the top side of the hook guide 15. In this configuration the hooks 14 have only a slight curvilinear shape, for example, about 80 degrees. In FIG. 1*b* the moveable base 13 is moved away from the first side 19 towards the second opposite side 20 of the hook guide 15, as indicated by the arrow. The free end (tip) of the hooks 14 move upward out of the hook guide 15, into the loop portion 12 and become more curvilinear, for example, about 180 degrees. In this configuration the loop portion 12 is firmly attached to the hook portion 11 and will resist removal by the peeling off of the loop portion 12 and the hook guide 15 from each other. FIG. 1 *c* shows the movable hook base 13 moved even further forward from the first side 19 towards the second opposite side 20 of the hook guide 15, as indicated by the arrow. The free ends or tips of the hooks 14 have moved even further into the loop portion 12 and have become even more curved, for example about 330 degrees wherein the tips of the hooks 14 curve down into the hook guide 15. In this configuration the loop portion 12 is even more firmly locked to the hook guide 15. FIG. 1*d* shows that as the movable hook base 13 is pulled away from the second opposite side 20 and towards the first side 19 of the hook guide 15, as shown by the arrow, the hooks 14 are pulled out of the loop portion 12 with little production of audible sound. Also, the loop portion 12 can be separated from the hook guide 15 with little resistance and with little audible sound.

Figure 2A:
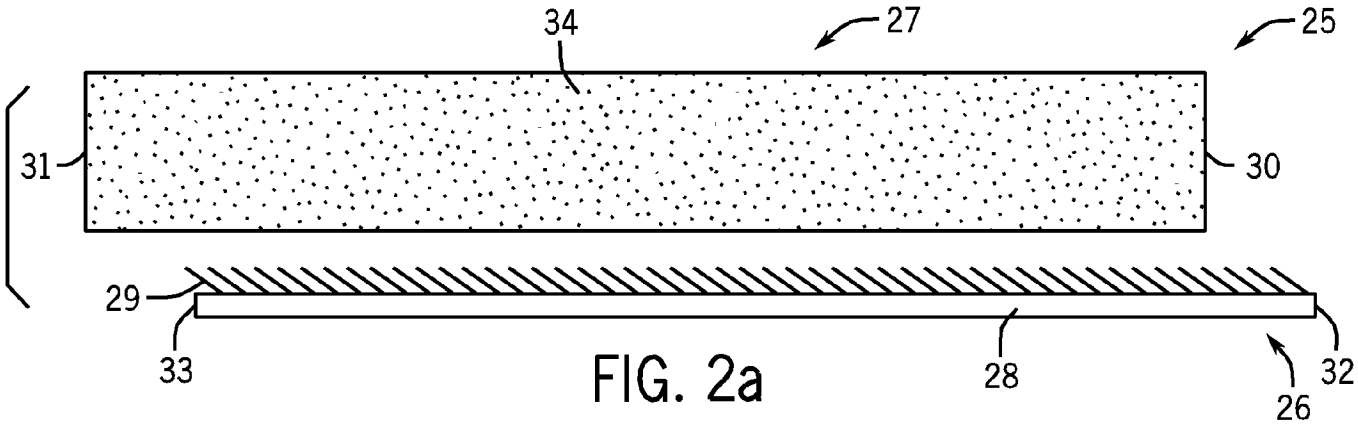
FIGS. 2*a*-2*b* show an embodiment using angled linear hooks on a rigid hook base.
Figure 2B:
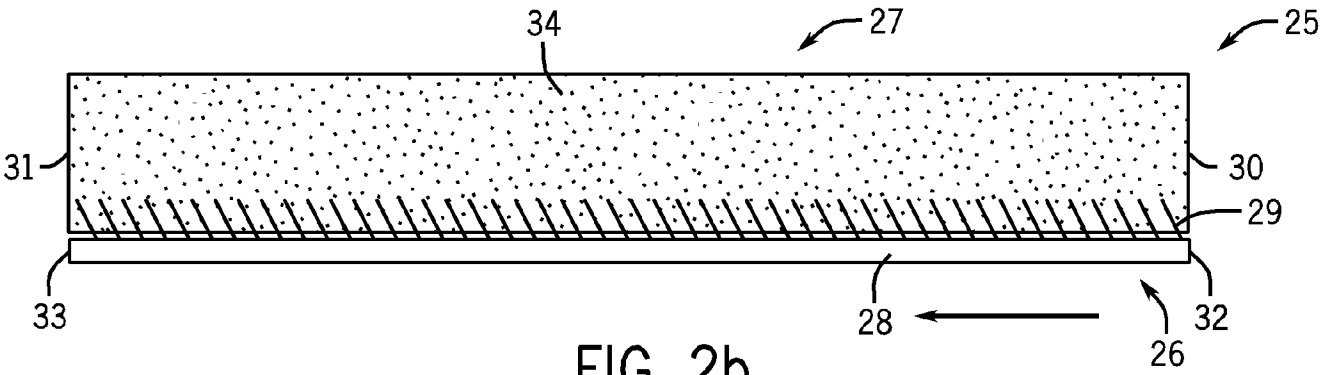

FIGS. 2*a*-2*b* show illustrations of a second embodiment of the present invention, silent fastener system 25. The fastener system 25 has a hook portion 26 and a loop portion 27. The hook portion 26 has a hook base 28 with hooks 29. The loop portion 27 has loops 34. The hooks 29 are linear and are attached to the hook base 28 at an angle of 20 degrees to 75 degrees, preferably 30 degrees, relative to the hook base 28. The hooks 29 are angled from a first side 32 of the hook base 28 towards a second opposite side 33 of the hook base 28. The loop portion 27 has a first side 30 and a second opposite side 31. FIG. 2*a* shows the loop portion 27 positioned over the hook portion 26. FIG. 2*b* shows the hook portion 26 in contact with the loop portion 27, with the hook base 28 pushed towards the second opposite side 31 of loop portion 27, as shown by the arrow, so that hooks 29 are pushed into the loop portion 27. In this configuration the loop portion 27 is firmly locked to the hook portion 26 and will resist removal by the peeling off of the hook portion 26 and loop portion 27 from each other. Moving the hook base 28 away from the second opposite side 31 of the loop portion 27, in the opposite direction of the arrow, will cause the hooks 29 to come out of the loop portion 27 with little production of audible sound. Also, the loop portion 26 can then be separated from the hook portion 27 with little resistance and with little audible sound.

Figure 3A:
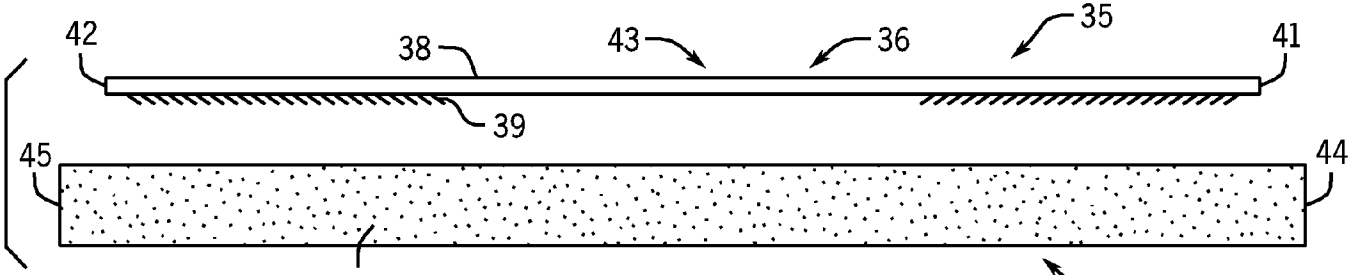
FIGS. 3*a*-3*c* show an embodiment using angled linear hooks on a stretchable hook base.
Figure 3B:
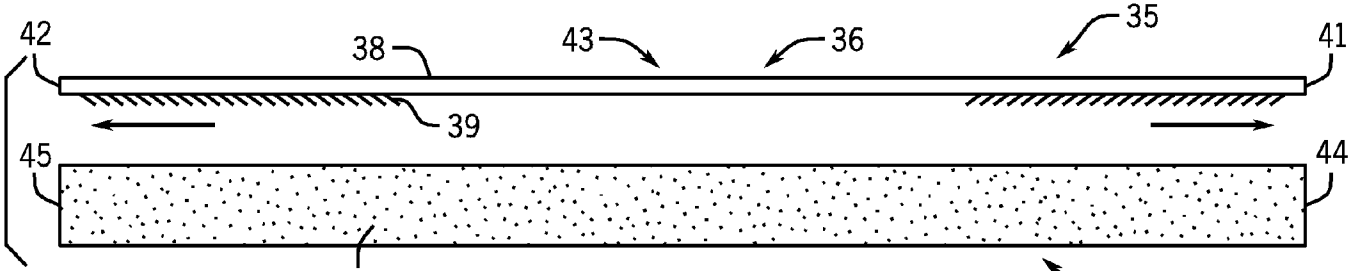
Figure 3C:
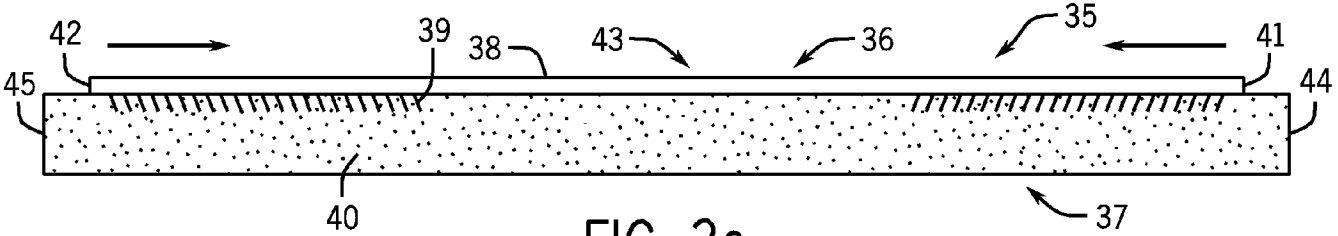

FIGS. 3*a*-3*c* show illustrations of a third embodiment, silent fastener system 35. The fastener system 35 has a hook portion 36 and a loop portion 37. The hook portion 26 has a stretchable hook base 38 with hooks 39. The loop portion 37 has loops 40. The hooks 39 are linear and attached to the stretchable base 38 at an angle of 20 degrees to 75 degrees, preferably 30 degrees, relative to the hook base 38. A plurality of hooks 39 are angled from a first side 41 of the stretchable hook base 38 towards a center 43 of the stretchable hook base 38, and a plurality of hooks 39 are angled from a second side 42 of the stretchable hook base 38 towards the center 43 of stretchable hook base 38. The loop portion has a first side 44 and a second opposite side 45. In FIG. 3*a* the hook portion 36 is positioned over the loop portion 37. In FIG. 3*b* the hook portion 36 is shown stretched, as indicated by the arrows, by pulling the first side 41 of the stretchable hook base 38 towards the first side 44 of the loop portion 37 and by pulling the second side 42 of the stretchable hook base 38 towards the second side 45 of the loop portion 37. The stretched hook portion 36 is placed on the loop portion 37 and the stretched hook portion 36 is released to allow the stretchable hook base 38 to return to its unstretched configuration, as shown by the arrows in FIG. 3*c*. In this configuration the loop portion 37 is firmly hooked to the hook portion 36 and will resist removal by the peeling off of the hook portion 36 and loop portion 37 from each other. Stretching the hook base 38 as described above will cause the hooks 39 to come out of the loop portion 37 with little production of audible sound. Also, the loop portion 37 can then be separated from the hook portion 36 with little resistance and with little sound.

Figure 4A:
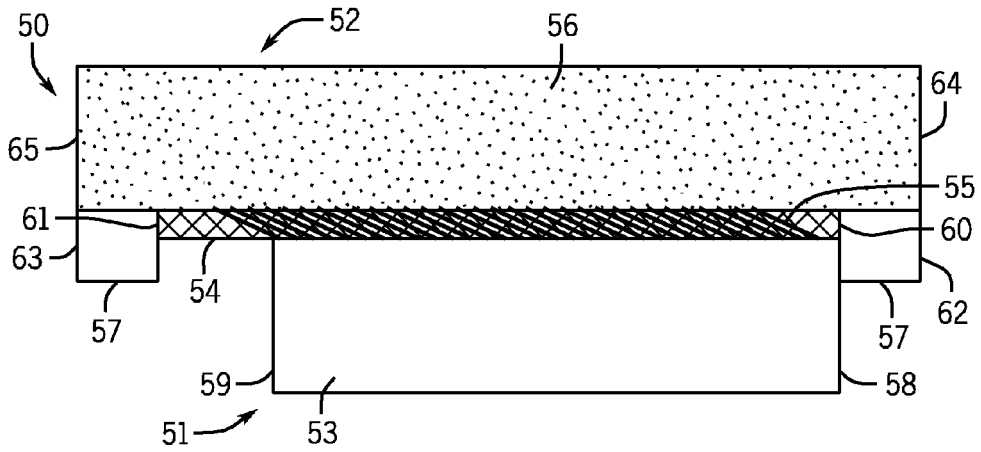
FIGS. 4*a*-4*b* show an embodiment using angled linear hooks on a sliding hook base
Figure 4B:
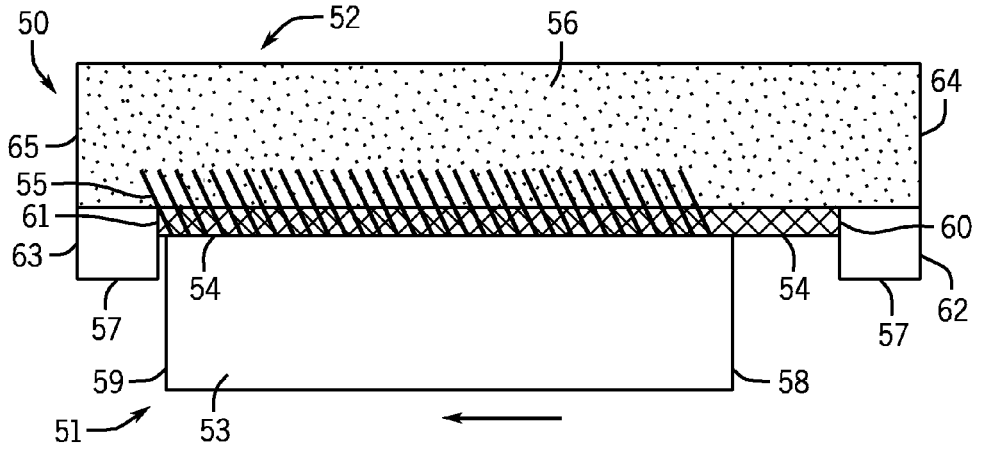

FIGS. 4*a*-4*b* show illustrations of a fourth embodiment, silent fastener system 50. The fastener 50 has a hook portion 51 and a loop portion 52. The hook portion 51 has a hook base 53 with a hook guide 54 and hooks 55 positioned within the hook guide 54. The loop portion has loops 56. The hooks 55 are linear and are attached to the hook base 53 at an angle of 20 to 75 degrees, preferably 30 degrees, relative to the hook base 53. The hooks 55 are angled from a first side 58 towards a second opposite side 59 of the hook base 53. The hook portion 51 is positioned within a housing 57. The hook guide 54 has a first side 60 and a second opposite side 61. The housing 57 has a first side 62 and a second opposite side 63. The loop portion 52 has a first side 64 and a second opposite side 65. FIG. 4*a* shows the hook base 53 positioned next to the first side 60 of the hook guide 54. In FIG. 4*b* the hook base 53 is shown pushed towards the second opposite side 61 of the hook guide 54 and towards the second opposite side 63 of the housing 57, as indicated by the arrow. In this configuration the hooks 55 are extended out of the hook guide 54 at an angle into the loop portion 52, whereby the loop portion 52 is, thus, firmly attached to the hook guide 54 and will resist removal by the peeling off of the hook guide 54 and the loop portion 52 from each other. Moving the hook base 53 back towards the first side of the hook guide 54 and first side 62 of housing 57 will pull the hooks 55 out of the loop portion 52 and into the hook guide 54 with little production of audible sound. Also, the loop portion 52 can then be separated from the hook guide 54 with little resistance and with little sound.

Figure 5A:
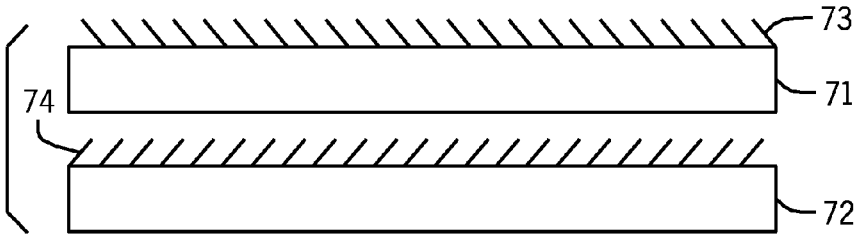
FIGS. 5*a*-5*d* show an embodiment using angled linear hooks that overlap on sliding hook bases.
Figure 5B:
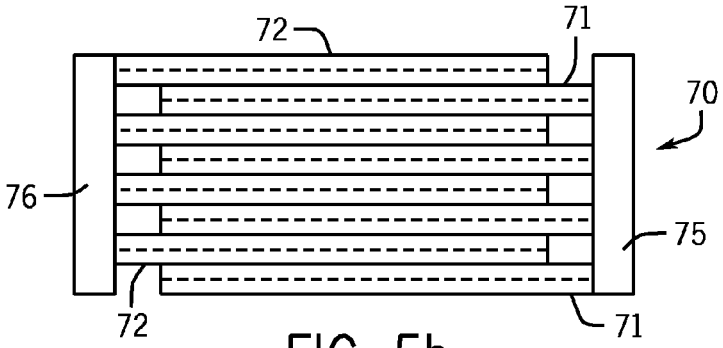
Figure 5C:
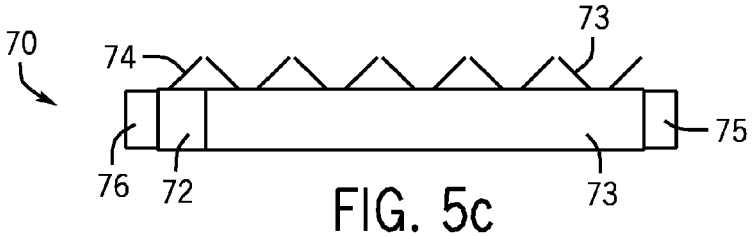
Figure 5D:
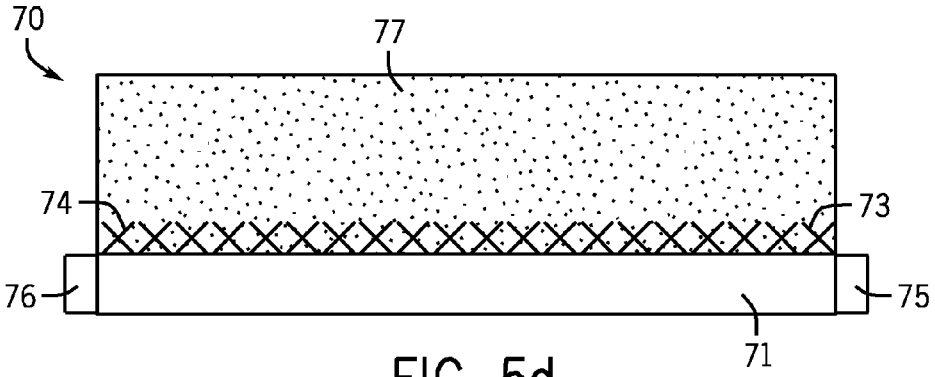

FIGS. 5*a*-5*d* show illustrations of a fifth embodiment, silent fastener system 70. FIG. 5*a* shows a pair of hook bases, a first hook base 71 and a second hook base 72. Hook base 71 has linear first hooks 73 which are angled to the left (in a first direction in line with first hook base 71) at an angle of 20 to 75 degrees, preferably 30 degrees, relative to hook base 71. Hook base 72 has linear second hooks 74 which are angled to the right (in a second opposite direction in line with second hook base 72) at an angle of 20 to 75 degrees, preferably 30 degrees, relative to hook base 72. A plurality of first hook bases 71 are attached to a first base holder 75 and a plurality of hook bases 72 are attached to a second base holder 76. There are spaces between each of the hook bases 71 and 72 so that hook bases 71 and 72 are slidably positioned next to each other as illustrated in a top view of the silent fastener system 70 in FIG. 5*b*. In this configuration there are alternating rows of hook bases 71 and 72 so that there are alternating rows of first hooks 73 and second hooks 74. When the base holders 75 and 76 are pulled away from each other as shown in FIG. 5*b*, the first and second hooks 73, 74 do not cross over or overlap each other, as shown in a side view of the silent fastener system 70 in FIG. 5*c*. In FIG. 5*d* the hook bases 71, 72 have been placed against a loop material 77. The base holders 75, 76 have been moved or pushed towards each other so that the first and second hooks 73, 74 enter the loop material 77 at opposite angles, crossing over, or over lapping, each other. This crossing over configuration creates a secure lock of the first and second hooks 73, 74 in the loop material 77.

Any suitable mechanism may be used to push or move the base holders 75,76 together simultaneously to lock the first and second hooks 73, 74 into loop material 77, and to unlock the first and second hooks 73, 74 from loop material 77 by pulling or moving the base holders 75, 76 apart. Such a mechanism could include a knob with gearing providing the desired action. Alternatively, elastic bands, as illustrated in FIGS. 3*a*-3*c*, could be used as hook bases 71, 72. Pulling the elastic bands would unlock (uncross) the hooks 73, 74. Allowing the elastic bands to contract would allow the hooks 73, 74 to cross each other within the loop material 77. As described for the other embodiments above, pulling or moving the hooks 73, 74 away from each other would allow the hooks 73, 74 to be removed from the loop material 77 with little or no production of any audible sound or noise.

The hook portion and the loop portion of the various embodiments can have any desired orientation with regard to their attachment to each other. The hook portion may be held in a fixed position while the loop portion is applied to the hook portion. The loop portion may be held in a fixed position while the hook portion is applied to the loop portion. The loop portion may be fixed to a first movable surface and the hook portion may be applied to a second movable surface wherein the hook portion and the loop portion are used to attach the first movable surface to the second movable surface.

The hook guide in the various embodiments can be made of any suitable mesh or grid-like material. Any kind of stopper mechanism may be used to restrict the movement of the hook base or hook portion from one side of the hook guide or loop portion to the other side of the hook guide or loop portion. The hook and loop materials may be made from any suitable types of plastic, metal, textile, or combinations thereof.

With respect to the above description then, it is to be realized that the optimum dimensional relationships for the parts of the invention, to include variations in size, materials, shape, form, function and manner of operation, assembly and use, are deemed readily apparent and obvious to one of ordinary skill in the art, and all equivalent relationships to those illustrated in the drawings and described in the specification are intended to be encompassed by the present invention. For example, other types of loop materials may be used in addition to open loop piles. The straight or curved hooks may also attach to other materials such as foam, plastic, leather, cloth or skin. Attachment of hooks on a stretchable base for attachment to skin would be useful to close wounds in emergency situations because the hooks could penetrate the top layer of skin on one side of a wound and the stretchable material could close the wound when the hooks on the opposite side are attached to the skin, pulling the sides of the wound together. This method would also work on closing rips or tears in leather and the like. The hook and loop fastener system may also have circular and screw-type spiral configurations.

Therefore, the foregoing is considered as illustrative only of the principles of the invention. Further, since numerous modifications and changes will readily occur to those of ordinary skill in the art, it is not desired to limit the invention to the exact construction and operation shown and described, and accordingly, all suitable modifications and equivalents may be resorted to, falling within the scope of the invention.

We claim:

1. A fastener system, comprising:

a) a hook portion and a loop portion;

b) said hook portion having a base with hooks attached thereto, said hooks biased in a curved configuration; and c) a hook guide through which said hooks are moveably inserted and remain therein; and;

d) said base being laterally movable relative to said guide so that lateral movement of said base selectively moves said hook into and out of said hook guide; wherein said hooks extend from said hook guide and into said loop portion or wherein said hooks extend from said hook guide, extend through said loop portion and extend back into said hook guide without producing sound.

2. A method of attaching a hook portion of a fastener system to a loop portion of a fastener system, comprising the steps of:

1) providing the fastener system of claim 1;

2) positioning said hook guide adjacent to said loop portion;

3) moving said base laterally along said hook guide in a first direction to move tips of said hooks through said hook guide into said loop portion, thereby attaching said hook portion to said loop portion.

3. The method of claim 2, further comprising moving said base laterally along said hook guide in said first direction to move said tips of said hooks back into said hook guide, thereby locking said hook portion to said loop portion.

4. The method of claim 3, further comprising moving said base laterally along said hook guide in a second opposite direction to move said hook tips out of said hook guide, thereby unlocking said hook portion from said loop portion.

5. The method of claim 4, further comprising moving said base laterally along said hook guide in a second opposite direction to move said hook tips out of said loop portion, thereby allowing separation of said hook portion from said loop portion without producing audible sound.

* * * * *